US006560797B2

(12) United States Patent
Maturaporn

(10) Patent No.: US 6,560,797 B2
(45) Date of Patent: May 13, 2003

(54) DISPOSABLE BLANKET

(76) Inventor: Thawatchai Maturaporn, 861/8 T.I.T. Tower Building, Soi Wat-Paingern, Bangklo, Bangkorlaem, Bangkok 10120 (TH)

( * ) Notice: Subject to any disclaimer, the term of this patent is extended or adjusted under 35 U.S.C. 154(b) by 30 days.

(21) Appl. No.: 09/844,638

(22) Filed: Apr. 27, 2001

(65) Prior Publication Data

US 2002/0157184 A1 Oct. 31, 2002

(51) Int. Cl.[7] ..... A61F 7/00
(52) U.S. Cl. ..... 5/482; 5/487; 5/494
(58) Field of Search ..... 5/482, 487, 494, 5/413 R, 423; 156/73.1, 73.4

(56) References Cited

U.S. PATENT DOCUMENTS 2,302,844 A * 11/1942 Ebbott ..... 5/482 X
4,768,247 A * 9/1988 Beier ..... 5/490
4,938,817 A * 7/1990 Langley ..... 156/157
5,443,488 A * 8/1995 Namenye et al. ..... 165/46

* cited by examiner

*Primary Examiner*—Heather Shackelford
*Assistant Examiner*—Fredrick Conley
(74) *Attorney, Agent, or Firm*—Raymond Y. Chan; David and Raymond Patent Group

(57) ABSTRACT

A disposable blanket includes a cover body having a size adapted for covering at least a body portion of a user so as to provide an insulating purpose. The cover body includes a plurality of cover sheets overlappedly attached together in an edge to edge manner, wherein a positioning opening having a predetermined length is formed on a side portion of the cover body for wearing the cover body in front of the user. Therefore, the user is able to wear the disposable blanket on his or her neck such that the entire disposable blanket can maintain its position on the user's body so as to prevent the disposable blanket from being unfolded unintentionally.

24 Claims, 3 Drawing Sheets

DISPOSABLE BLANKET

BACKGROUND OF THE PRESENT INVENTION

1. Field of Invention

The present invention relates to a blanket, and more particularly to a disposable blanket which is adapted for providing an insulating purpose and is well suited for disposable one-time use for hygiene purpose so as to prevent any disease, such as skin disease, infected from other people especially patients.

2. Description of Related Arts

Blankets are used at bedtime year round. During sleeping or resting, human body tends to decrease his or her body temperature so that a blanket is needed to conserve the heat. Especially patients and children, their bodies are weak such that when the room is not adequately heated. The blanket becomes a necessary shield against the cold.

For hygiene purpose, all the diagnostic instruments used in clinic and hospital must be sterilized. Otherwise, the used instruments must be disposed in order to protect any infection from the previous patient. However, most of the nurses may ignore the hygiene of the blanket, especially the blanket is repeatedly used by the patients. Even though the blanket has been washed every time after use, the blanket is not absolutely clean that any germs may still exist on the blanket unless the blanket is purposely for disposable one-time use. However, the disposal of the cotton made blanket is a waste of source.

The blanket covers up people's body to conserve the heat. However, people especially children and patients may unfold the blanket unintentionally and they cannot tuck it back. So, they often endure the cold for remainder of the night. It is not a wise decision and often leads to sickness. Children are especially susceptible to become sick when they are not kept warm during the night.

SUMMARY OF THE PRESENT INVENTION

A main object of the present invention is to provide a disposable blanket which is adapted for providing an insulating purpose for heat conservation.

Another object of the present invention is to provide a disposable blanket provided with a wearing arrangement for firmly positioning the disposable blanket on the user and maintaining the cover body covering on the user's body.

Another object of the present invention is to provide a disposable blanket which is safe and easy to use since the blanket is designed to dispose after use, so as to prevent pollution by bacteria from a previous user of the blanket. Moreover, the disposable blanket of the present invention can also prevent any disease, such as skin disease, infected from other people especially patients for hygiene purpose.

Another object of the present invention is to provide a disposable blanket which is easy and economical for mass production. Therefore, the disposable blanket is well suited for disposable one-time use since the disposable blanket is made of synthetic fabric.

Another object of the present invention is to provide a disposable blanket which is adapted for being folded into a compact size for storage easily.

Another object of the present invention is to provide a disposable blanket which is made of synthetic fabric or any kind of non-woven material that is capable of recycling in use after further treatment, so as to prevent a waste of resource.

Accordingly, in order to accomplish the above objects, the present invention provides a disposable blanket which comprises:

a plurality of cover sheets, each having the same shape and size and being made of synthetic fabric, wherein the cover sheets are overlappedly disposed in layer by layer manner to form a cover body having a predetermined thickness and side edges, and an edge protecting device comprising at least a synthetic fabric made elongated protection strap, having a U-shaped cross section longitudinally defining a top leaf and a bottom leaf, wherein said protection strap is extended along the side edges of the cover body to sandwich the side edges of the cover body between the top leaf and the bottom leaf of the protection strap, wherein the top leaf, side edges of the cover body and the bottom leaf are integrally connected together by ultrasonic welding so as to form an ultrasonic integrated stripe extending along edges of the top leaf and the bottom leaf of the protection strap, and thus the side edges of all the cover sheets which are all separated with each other are enclosed by the protection strap and the layers of cover sheets are also sealedly and firmly attached together along the side edges thereof to form the disposable blanket in such as manner that air layers are retained between said cover sheets to enhance heat insulation ability;

wherein a wearing arrangement is provided on the cover body for firmly positioning the disposable blanket on a user and maintaining the cover body covering on the user's body, wherein the wearing arrangement includes a positioning opening which is a transverse slit, having a predetermined length, formed on a side portion of the cover body by cutting through all the cover sheets, and that both sides of the slit are provided with two side ultrasonic integrated stripes by sealedly attaching the cover sheets together by ultrasonic welding; whereby, the user is capable of passing through his or her head through the positioning opening so as to wear the disposable blanket on his or her neck so that the entire disposable blanket can maintain its position on the user's body.

DETAILED DESCRIPTION OF THE PREFERRED EMBODIMENT

Referring to FIGS. 1 to 4 of the drawings, a disposable blanket 1 according to a preferred embodiment of the present invention is illustrated, which comprises a cover body 10 having a size adapted for covering at least a body portion of a user A, a wearing arrangement 20 and an edge protecting device 30.

Figure 1:
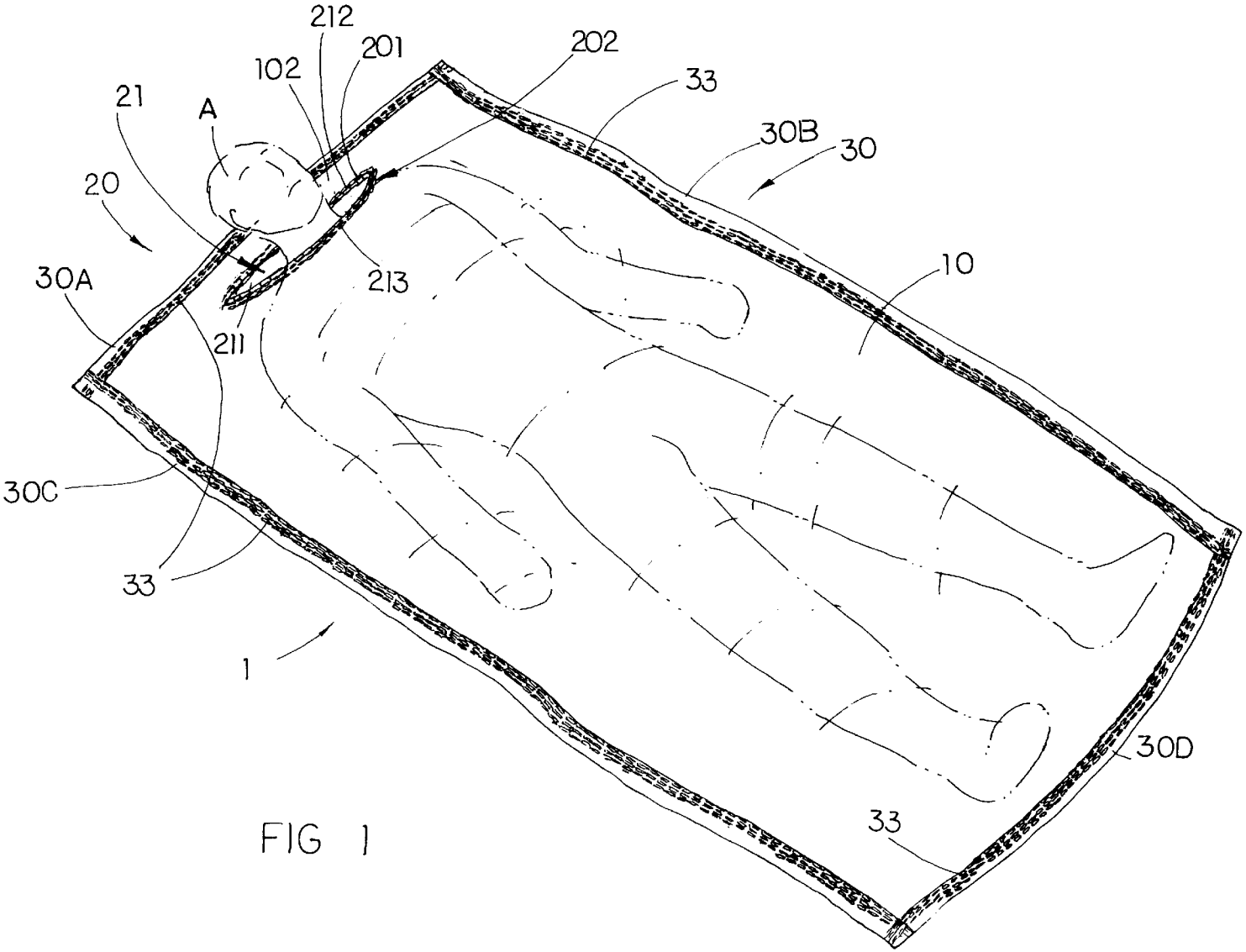
FIG. 1 is a perspective view of a disposable blanket illustrated as covering a user according to a preferred embodiment of the present invention.
Figure 2:
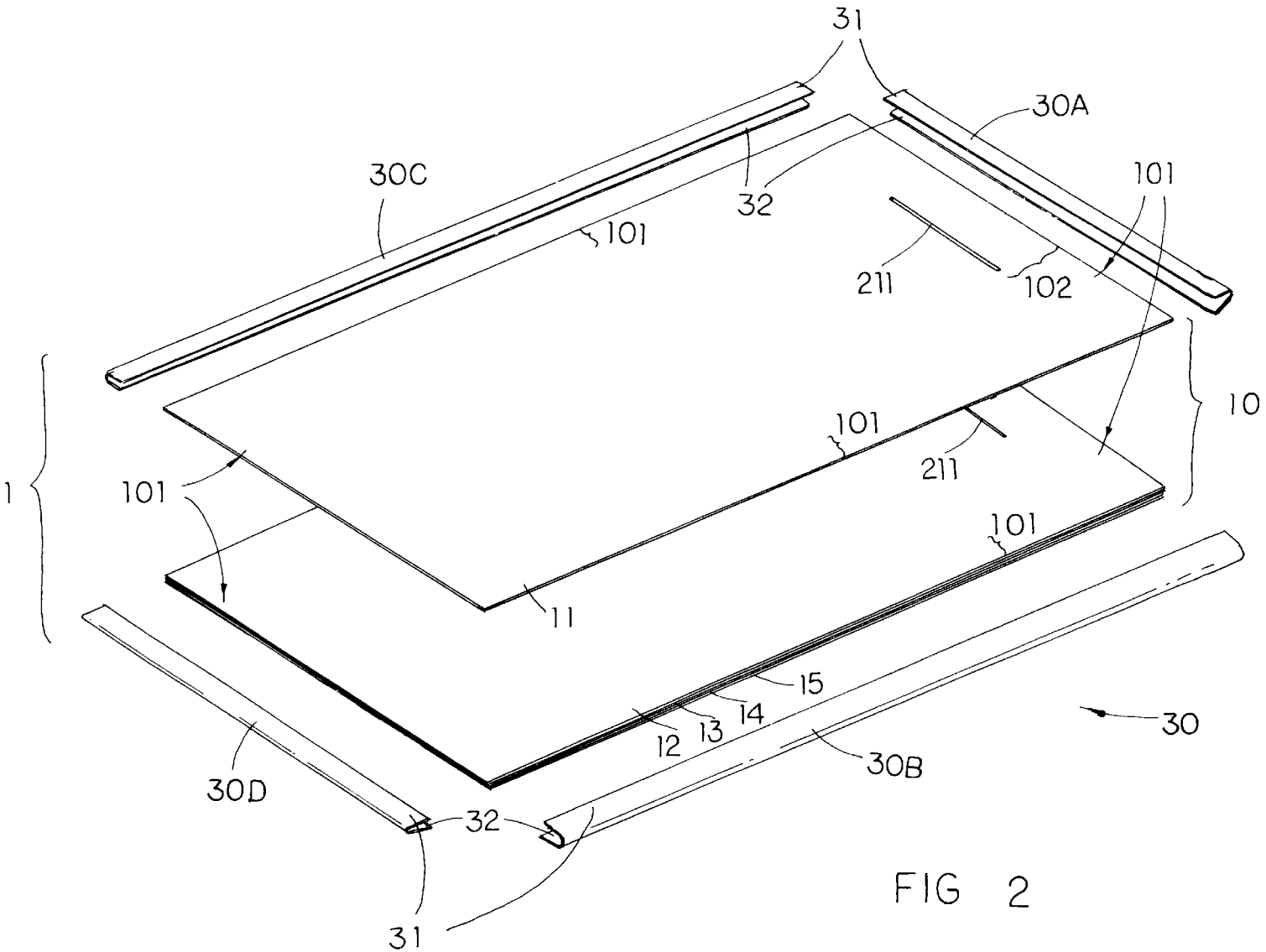
FIG. 2 is an exploded perspective view of the disposable blanket according to the above preferred embodiment of the present invention.
Figure 3:
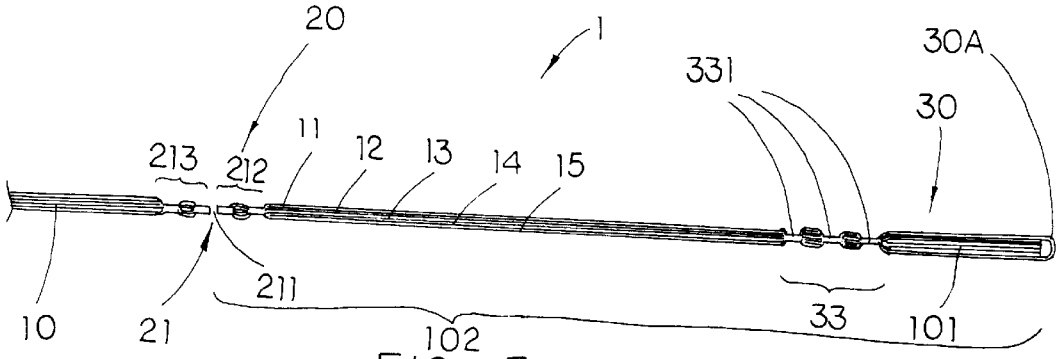
FIG. 3 is a partially sectional view of the disposable blanket according to the above preferred embodiment of the present invention.
Figure 4:
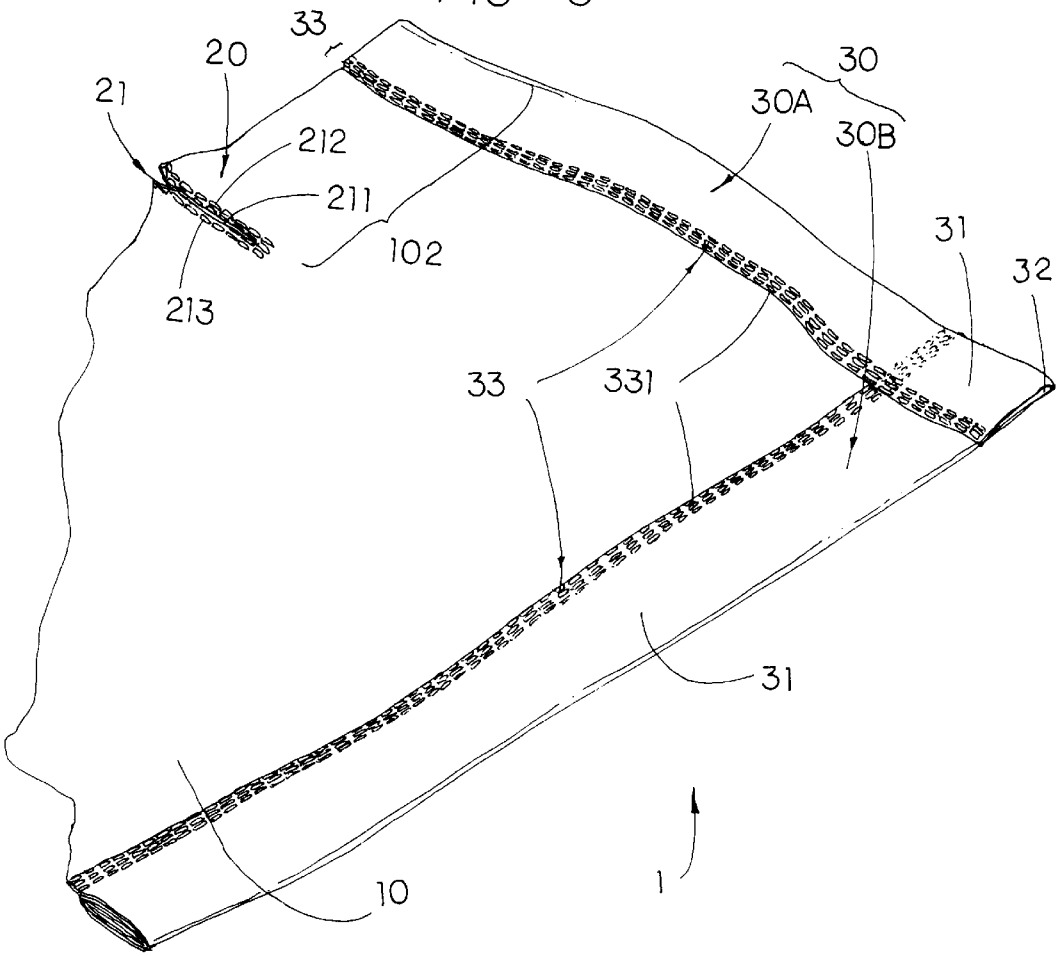
FIG. 4 is a partial perspective view of the disposable blanket according to the above preferred embodiment of the present invention.

The cover body 10 comprises a plurality of cover sheets 11, 12, 13, 14, 15, each having the same shape and size and being made of synthetic fabric or any kind of non-woven material, with or without embossing patterns thereon, wherein the cover sheets 11~15 are overlappedly disposed in layer by layer manner to form the cover body 10 having a predetermined thickness and side edges 101, as shown in FIGS. 2 and 3.

The edge protecting device 30 comprises at least an elongated protection strap 31, which is made of synthetic fabric or any kind of non-woven material, having a length at least equal to the total length of all the side edges 101 of the cover body for enclosing all the separating side edges 101 together so as to sealedly and firmly attach the cover sheets 11~15 together along the side edges 101 thereof to form the disposable blanket 10.

According to the preferred embodiment, since the cover body 10 is embodied to have a rectangular shape, the protection strap can be precut into four elongated protection straps 30A, 30B, 30C, 30D having lengths equal to the four side edges 101 of the cover body 10 respectively. Each of the protection straps 30A~30D has a U-shaped cross section longitudinally defining a top leaf 31 and a bottom leaf 32, and is extended along the side edges 101 of the cover body 10 to sandwich the side edges 101 of the cover body 10 between the top leaf 31 and the bottom leaf 32 of the protection strap 30A~30D, as shown in FIG. 3.

The top leaf 3, side edges 101 of all the cover sheets 11~15 of the cover body 10 and the bottom leaf 32 are integrally connected together by ultrasonic welding so as to form four ultrasonic integrated stripes 33 extending alone edges of the top leaf 31 and the bottom leaf 32 of the four protection straps 30A~30D respectively, as shown in FIGS. 2 and 3.

The present invention is safe to us. The disposable blanket of the present invention, which is preferred to be packed in the vacuum packaging, is disposed for on-time use, so that the user, especially the patient, will not have any indirect kin-contact with the previous patient in order to infect any disease from the previous one.

Each of the ultrasonic integrated stripes 33 of the protection straps 30A~30D comprises at least one line of ultrasonic welding spots 331 spacedly aligned along the length of the respective protection strap 30A~30D. According to the embodiment, there are totally three parallel lines of ultrasonic welding spots 331 aligned closely spaced together to provide good sealing and affixing features.

The wearing arrangement 20 is provided on the cover body 10 for firmly positioning the disposable blanket 1 on the user A and maintaining the cover body 10 covering on the user's body, wherein the wearing arrangement 20 includes a positioning opening 21 which is a transverse slit 211, having a predetermined length longer than the width of the user's head, formed on a central position of a side portion of the cover body 10 by cutting through all the cover sheets 11~15.

Moreover, both sides of the transverse slit 211 are provided with two side ultrasonic integrated stripes 212, 213 by sealedly, attaching the cover sheets 11~15 together by ultrasonic welding. Thereby, the user A is capable of passing through his or her head through the positioning opening 21 so as to wear the disposable blanket 1 on his or her neck so that the entire disposable blanket 1 can maintain its position on the user's body.

Practically, the positioning opening 21 and the two side ultrasonic integrated stripes 212, 213 can be simply made by firstly, forming one single ultrasonic integrated strip having three or more lines of slightly spaced ultrasonic welding spots 214 on the side portion of cover body 10 so as to welding the cover sheets 11~15 integrally together to form a welded stripe having a predetermined length and width, and secondly, cutting a slit along a central line of the welded stripe and to form the positioning opening 21, wherein two ends of transverse slit 211 are preferred to be ended before two ends of the welded stripe respectively.

Both the cover body 10 and the protection straps 30A~30D are preferably made of fabric such as synthetic paper that should be non-irritant and has a disinfectious ability or preventing germs and skin disease from being infected such that the cover body 10 is easy and economical to manufacture so as to well suit for disposable one-time use safety. wherein protection straps 30A~30D arc preferred to be made of more thin and soft material so as to prevent increasing thickness of the side edges of the cover body 10. Moreover, the used cover body 10 can be collected and recycled after further treatment such as sterilization.

It is worth to mention that air is trapped between the cover sheets 11~15 so as to provide an insulating ability of the cover body 10. Since air is one of the best heat insulators, the cover body 10 can conserve heat efficiently. In other words, the more cover sheets 11~15 to form the cover body 10, the better heat insulation of the cover body 10 will be provided. Preferably, the cover body 10 comprises five to seven cover sheets 11~15 for providing adequate heat insulation thereof.

The positioning opening 21 is parallely formed on the cover body 10 with respect to the top side edge thereof, wherein a retaining portion 102 of the cover body 10 is defined between the top side edge and the positioning opening 21 in such a manner that the retaining portion 102 of the cover body 10 is positioned behind the user's neck when the cover body 10 is worn on the user. Preferably, the retaining portion 102 of the cover body 10 has a width approximately 10 centimeters. It is worth to mention that the positioning opening 21 can be formed in curved shape instead of a straight cut for fit the shape of the user's neck without complicating the manufacturing process of the present invention.

In accordance with the preferred embodiment as disclosed above, the advantages of the disposable blanket of the present invention include the following:

1. The cover body is capable of conserving heat to provide an insulating purpose by having air layers between the cover sheets of the cover body.

2. The disposable blanket is provided with a wearing arrangement for firmly positioning the disposable blanket on the user and maintaining the cover body covering on the user's body.

3. The present invention is safe to use. The present invention is disposed for one-time use, so that the user, especially the patient, will not have any indirect kin-contact with the previous patient in order to infect any disease from the previous one.

4. The present invention is easy and economical to manufacture. Since the cover body is made of paper fabric, the blanket can easily be manufactured by garment techniques commonly known to those skilled in the art. Since the disposable blanket is economical to manufacture, the present invention is well suited for disposable one time-time use.

5. The disposable blanket of the present invention can be folded into a compact size for easily storage. Unlike the conventional blanket, the disposable blanket occupies less storage space such that more disposable blankets can be stored one space comparing with the conventional blanket. Especially in hospital and airplane, the space for storage is very limited and thus the patients and passengers prefer to use a clean and safe blanket rather than the used one so that the disposable blanket of the present invention absolutely fit for them.

6. The disposable blanket is capable of wearing on the user by passing the user's head through the positioning opening such that the cover body is maintained to cover on top of the user's body. Especially children and patients, they may unfold the blanket unintentionally and they cannot tuck it back. So, the positioning slit can avoid the user unfold the disposable blanket unintentionally.

What is claimed is:

1. A disposable blanket, comprising:

a plurality of cover sheets, each having a same shape and size, being overlappedly disposed in layer by layer manner to form a cover body having a predetermined thickness and side edges, an edge protecting device for combining said cover sheets together in an edge to edge manner, wherein said edge protecting device comprises at least a synthetic fabric made elongated protection strap having a U-shaped cross section longitudinally defining a top leaf and a bottom leaf, wherein said protection strap is extended along said side edges of said cover body to sandwich said side edges of said cover body between said top leaf and said bottom leaf of said protection strap, wherein said top leaf, side edges of said cover body and said bottom leaf are integrally connected together by ultrasonic welding so as to form an ultrasonic integrated stripe extending along edges of said top leaf and said bottom leaf of said protection strap, and thus said side edges of all said cover sheets are enclosed by said protection strap and said layers of cover sheets are also sealedly and firmly attached together along said side edges thereof to form said disposable blanket which has air layers retained between said cover sheets to enhance heat insulation ability; and a wearing arrangement is provided on said cover body for firmly positioning said disposable blanket on a user and maintaining said cover body covering on top of said user.

2. A disposable blanket, as recited in claim 1, wherein said wearing arrangement includes a positioning opening which is a transverse slit, having a predetermined length, formed on a side portion of said cover body by cutting through all said cover sheets, and that both sides of said slit are provided with two side ultrasonic integrated stripes by sealedly attaching said cover sheets together by ultrasonic welding, so that said user is capable of passing through his or her head through said positioning opening so as to wear said disposable blanket on his or her neck in order to maintain said disposable blanket be worn on top of said user.

3. A disposable blanket, as recited in claim 2, wherein said cover body is made in rectangular shape and four of said elongated protection straps, each having lengths equal to four said side edges of said cover body respectively, are extended along said four side edges to sandwich said four side edges of said cover body between said top leaves and said bottom leaves of said four protection straps respectively, so as to wrap up said four side edges of said cover body respectively.

4. A disposable blanket, as recited in claim 3, wherein each of said ultrasonic integrated stripes of said protection straps comprises at least one line of ultrasonic welding spots aligned closely spaced together along said length of said respective protection strap.

5. A disposable blanket, as recited in claim 4, wherein both sides of said transverse slit are provided with two side ultrasonic integrated stripes by sealedly attaching said cover sheets together by ultrasonic welding.

6. A disposable blanket, as recited in claim 5, wherein said positioning opening and said two side ultrasonic integrated stripes are formed by forming one single ultrasonic integrated strip having three or more lines of slightly spaced ultrasonic welding spots on said side portion of cover body so as to welding said cover sheets integrally together to form a welded stripe having a predetermined length and width, and cutting a slit along a central line of said welded stripe and to form said positioning opening and said single ultrasonic integrated stripe is divided into said two side ultrasonic integrated stripes.

7. A disposable blanket, as recited in claim 3, wherein both sides of said transverse slit are provided with two side ultrasonic integrated stripes by sealedly attaching said cover sheets together by ultrasonic welding.

8. A disposable blanket, as recited in claim 7, wherein said positioning opening and said two side ultrasonic integrated stripes are formed by forming one single ultrasonic integrated strip having three or more lines of slightly spaced ultrasonic welding spots on said side portion of cover body so as to welding said cover sheets integrally together to form a welded stripe having a predetermined length and width, and cutting a slit along a central line of said welded stripe and to form said positioning opening and said single ultrasonic integrated stripe is divided into said two side ultrasonic integrated stripes.

9. A disposable blanket, as recited in claim 2, wherein said ultrasonic integrated strip of said protection strap comprises at least one line of ultrasonic welding spots continuously aligned along said length of said protection strap.

10. A disposable blanket, as recited in claim 9, wherein both sides of said transverse slit are provided with two side ultrasonic integrated stripes by sealedly attaching said cover sheets together by ultrasonic welding.

11. A disposable blanket, as recited in claim 10, wherein said positioning opening and said two side ultrasonic integrated stripes are formed by forming one single ultrasonic integrated strip having three or more lines of slightly spaced ultrasonic welding spots on said side portion of cover body so as to welding said cover sheets integrally together to form a welded stripe having a predetermined length and width, and cutting a slit along a central line of said welded stripe and to form said positioning opening and said single ultrasonic integrated stripe is divided into said two side ultrasonic integrated stripes.

12. A disposable blanket, as recited in claim 2, wherein both sides of said transverse slit are provided with two side ultrasonic integrated stripes by sealedly attaching said cover sheets together by ultrasonic welding.

13. A disposable blanket, as recited in claim 12, wherein said positioning opening and said two side ultrasonic integrated stripes are formed by forming one single ultrasonic integrated strip having three or more lines of slightly spaced ultrasonic welding spots on said side portion of cover body so as to welding said cover sheets integrally together to form a welded stripe having a predetermined length and width, and cutting a slit along a central line of said welded stripe and to form said positioning opening and said single ultrasonic integrated stripe is divided into said two side ultrasonic integrated stripes.

14. A disposable blanket, as recited in claim 1, wherein said cover body is made in rectangular shape and four of said elongated protection straps, each having lengths equal to four said side edges of said cover body respectively, are extended along said four side edges to sandwich said four side edges of said cover body between said top leaves and said bottom leaves of said four protection straps respectively, so as to wrap up said four side edges of said cover body respectively.

15. A disposable blanket, as recited in claim 14, wherein each of said ultrasonic integrated stripes of said protection straps comprises at least one line of ultrasonic welding spots aligned closely spaced together along said length of said respective protection strap.

16. A disposable blanket, as recited in claim 15, wherein said wearing arrangement includes a positioning opening formed on a side portion of said cover body and both sides of said positioning opening are provided with two side ultrasonic integrated stripes by sealedly attaching said cover sheets together by ultrasonic welding.

17. A disposable blanket, as recited in claim 16, wherein said positioning opening and said two side ultrasonic integrated stripes are formed by forming one single ultrasonic integrated strip having three or more lines of slightly spaced ultrasonic welding spots on said side portion of cover body so as to welding said cover sheets integrally together to form a welded stripe having a predetermined length and width, and cutting a slit along a central line of said welded stripe and to form said positioning opening and said single ultrasonic integrated stripe is divided into said two side ultrasonic integrated stripes.

18. A disposable blanket, as recited in claim 14, wherein said wearing arrangement includes a positioning opening formed on a side portion of said cover body and both sides of said positioning opening are provided with two side ultrasonic integrated stripes by sealedly attaching said cover sheets together by ultrasonic welding.

19. A disposable blanket, as recited in claim 18, wherein said positioning opening and said two side ultrasonic integrated stripes are formed by forming one single ultrasonic integrated strip having three or more lines of slightly spaced ultrasonic welding spots on said side portion of cover body so as to welding said cover sheets integrally together to form a welded stripe having a predetermined length and width, and cutting a slit along a central line of said welded stripe and to form said positioning opening and said single ultrasonic integrated stripe is divided into said two side ultrasonic integrated stripes.

20. A disposable blanket, as recited in claim 1, wherein said ultrasonic integrated strip of said protection strap comprises at least one line of ultrasonic welding spots continuously aligned along said length of said protection strap.

21. A disposable blanket, as recited in claim 20, wherein said wearing arrangement includes a positioning opening formed on a side portion of said cover body and both sides of said positioning opening are provided with two side ultrasonic integrated stripes by sealedly attaching said cover sheets together by ultrasonic welding.

22. A disposable blanket, as recited in claim 21, wherein said positioning opening and said two side ultrasonic integrated stripes are formed by forming one single ultrasonic integrated strip having three or more lines of slightly spaced ultrasonic welding spots on said side portion of cover body so as to welding said cover sheets integrally together to form a welded stripe having a predetermined length and width, and cutting a slit along a central line of said welded stripe and to form said positioning opening and said single ultrasonic integrated stripe is divided into said two side ultrasonic integrated stripes.

23. A disposable blanket, as recited in claim 1, wherein said wearing arrangement includes a positioning opening formed on a side portion of said cover body and both sides of said positioning opening are provided with two side ultrasonic integrated stripes by sealedly attaching said cover sheets together by ultrasonic welding.

24. A disposable blanket, as recited in claim 23, wherein said positioning opening and said two side ultrasonic integrated stripes are formed by forming one single ultrasonic integrated strip having three or more lines of slightly spaced ultrasonic welding spots on said side portion of cover body so as to welding said cover sheets integrally together to form a welded stripe having a predetermined length and width, and cutting a slit along a central line of said welded stripe and to form said positioning opening and said single ultrasonic integrated stripe is divided into said two side ultrasonic integrated stripes.

* * * * *